US005408976A

United States Patent [19]

Reddy

[11] Patent Number: 5,408,976

[45] Date of Patent: Apr. 25, 1995

[54] SWELLABLE ADSORBENT DIAGNOSTIC FOR FUEL VAPOR HANDLING SYSTEM

[75] Inventor: Sam R. Reddy, Bloomfield, Mich.

[73] Assignee: General Motors Corporation, Detroit, Mich.

[21] Appl. No.: 235,960

[22] Filed: May 2, 1994

[51] Int. Cl.[6] ..... F02M 33/02

[52] U.S. Cl. ..... 123/519; 123/520; 123/198 D

[58] Field of Search ..... 123/516, 518, 519, 520, 123/198 D

[56] References Cited

U.S. PATENT DOCUMENTS

| | | | |
|---|---|---|---|
| 4,684,382 | 8/1987 | Abu-Isa | 55/316 |
| 4,700,750 | 10/1987 | Cook | 138/46 |
| 4,766,872 | 8/1988 | Kato et al. | 123/519 |
| 4,872,439 | 10/1989 | Sonoda et al. | 123/518 |
| 4,877,001 | 10/1989 | Kenealy et al. | 123/519 |
| 4,944,779 | 7/1990 | Szlaga et al. | 55/168 |
| 5,098,453 | 3/1992 | Turner et al. | 123/519 |
| 5,119,791 | 6/1992 | Gifford et al. | 123/519 |
| 5,122,172 | 6/1992 | Sherwood et al. | 123/519 |
| 5,146,902 | 9/1992 | Cook et al. | 123/518 |
| 5,148,793 | 9/1992 | Reddy | 123/520 |
| 5,150,689 | 9/1992 | Yano et al. | 123/519 |
| 5,158,054 | 10/1992 | Otsuka | 123/198 D |
| 5,170,765 | 12/1992 | Hoshino et al. | 123/520 |
| 5,173,095 | 12/1992 | Yasukawa et al. | 55/316 |
| 5,191,870 | 3/1993 | Cook | 123/520 |
| 5,193,512 | 3/1993 | Steinbrenner et al. | 123/520 |
| 5,207,808 | 5/1993 | Haruta et al. | 55/316 |
| 5,263,462 | 11/1993 | Reddy | 123/520 |
| 5,269,837 | 12/1993 | Ohashi et al. | 96/126 |
| 5,348,929 | 9/1994 | Ito et al. | 502/402 |

*Primary Examiner*—Willis R. Wolfe
*Assistant Examiner*—Thomas N. Moulis
*Attorney, Agent, or Firm*—Jeffrey A. Sedlar

[57] ABSTRACT

An apparatus and method for use in diagnosing an evaporative emission canister collection and purge system. An EVAP system of a vehicle can be diagnosed through the use of a swellable adsorbent disposed in the system's canister. The swellable adsorbent is expandable upon adsorption of fuel vapors and contractible upon desorption. By sensing the expansion and contraction response, a diagnostic mechanism can determine whether the vapor collection and purge functions are operating properly.

9 Claims, 4 Drawing Sheets

SWELLABLE ADSORBENT DIAGNOSTIC FOR FUEL VAPOR HANDLING SYSTEM

BACKGROUND OF THE INVENTION

This invention relates to a fuel vapor handling system. More particularly, the invention is directed to an apparatus and method for use in diagnosing the system. The subject of this application is related to the following copending patent application: Ser. No. 08/236,071, filed May 2, 1994, entitled Conductivity Sensor Diagnostic for Fuel Vapor Handling System, filed concurrently with this specification and assigned to the assignee of this invention.

Automobiles conventionally include a system directed to controlling the emission of fuel vapors generated by fuel carried in the vehicle's fuel system. These evaporative emission control systems, known as "EVAP" systems, are implemented as a collateral system to the fuel system. The diurnal and running loss vapors the EVAP system collects result primarily from ambient temperature excursions and from the cyclic operation and parking of a vehicle that results from the operator's use of the vehicle as transportation.

An EVAP system typically includes a vapor collection system with an adsorption mechanism to capture and store vapors generated by the fuel system. The EVAP system also includes a purge system to transfer the stored vapors from the adsorbent to the vehicle's engine for consumption in the normal combustion process. The purge system generally includes a purge valve that selectively opens a passage between the EVAP system and the vehicle's engine to effect a controllable rate of purge.

Conventionally, effective diagnosis of an EVAP system is generally provided through manual inspection of the system in response to noticeable engine performance degradation or noticeable fuel or vapor leakage. Periodic manual vacuum testing for leaks and purge valve functional checking provides additional effectiveness in diagnosing system operation.

Research has been conducted into developing on-board means for automatically diagnosing EVAP systems, capable of automatically detecting leaks in the system and determining whether the purge system is operating properly. Development of on-board automatic diagnostic systems has generally resulted in proposed systems related to mechanisms that close the EVAP system off from the atmosphere and then generate a positive or negative internal system pressure. By then measuring changes in the system pressure, the diagnostic mechanisms attempt to discern whether the evaporative control system is functioning properly.

Generally, sensitive diagnostic systems are proposed with precision pressure detection devices to work on small pressure differentials. To avoid unacceptable erroneous fault reporting, a pressure based diagnostic system must be able to discern that unexpected pressure gradients are a result of system malfunctions and not changing ambient conditions or other normal collateral effects. This tends to complicate and drive up the cost of a diagnostic mechanism. Accordingly, automatic EVAP diagnostic systems have proven difficult to implement.

Adsorption canister collection and storage system use in on-board refueling vapor recovery (ORVR) systems is known. ORVR systems are vehicle based systems directed to capturing fuel vapors generated by the transfer of fuel from a pump to a vehicle. ORVR systems have been proposed that are configured in a manner similar to an EVAP system including a storage canister and a purge system.

SUMMARY OF THE INVENTION

This invention is directed to a fuel vapor handling system and generally includes a fuel vapor storage canister containing a swellable adsorbent material expandable and contractible in response to changes in fuel vapor concentration. A sensor to detect expansion and contraction of the adsorbent is provided for use in assisting automatic diagnosis of the system. A diagnostic system is preferably provided as part of a vehicle's conventional electronic controller, capable of utilizing expansion and contraction data generated from the adsorbent in diagnosing the system.

The swellable adsorbent system is directed to a device that provides for automatically assisting in diagnosis of the vapor collection and purge systems, functions without closing the fuel vapor control system off from the atmosphere and can be implemented with minor changes to existing fuel vapor control system components.

DETAILED DESCRIPTION OF THE PRESENTLY PREFERRED EMBODIMENT

Figure 1:
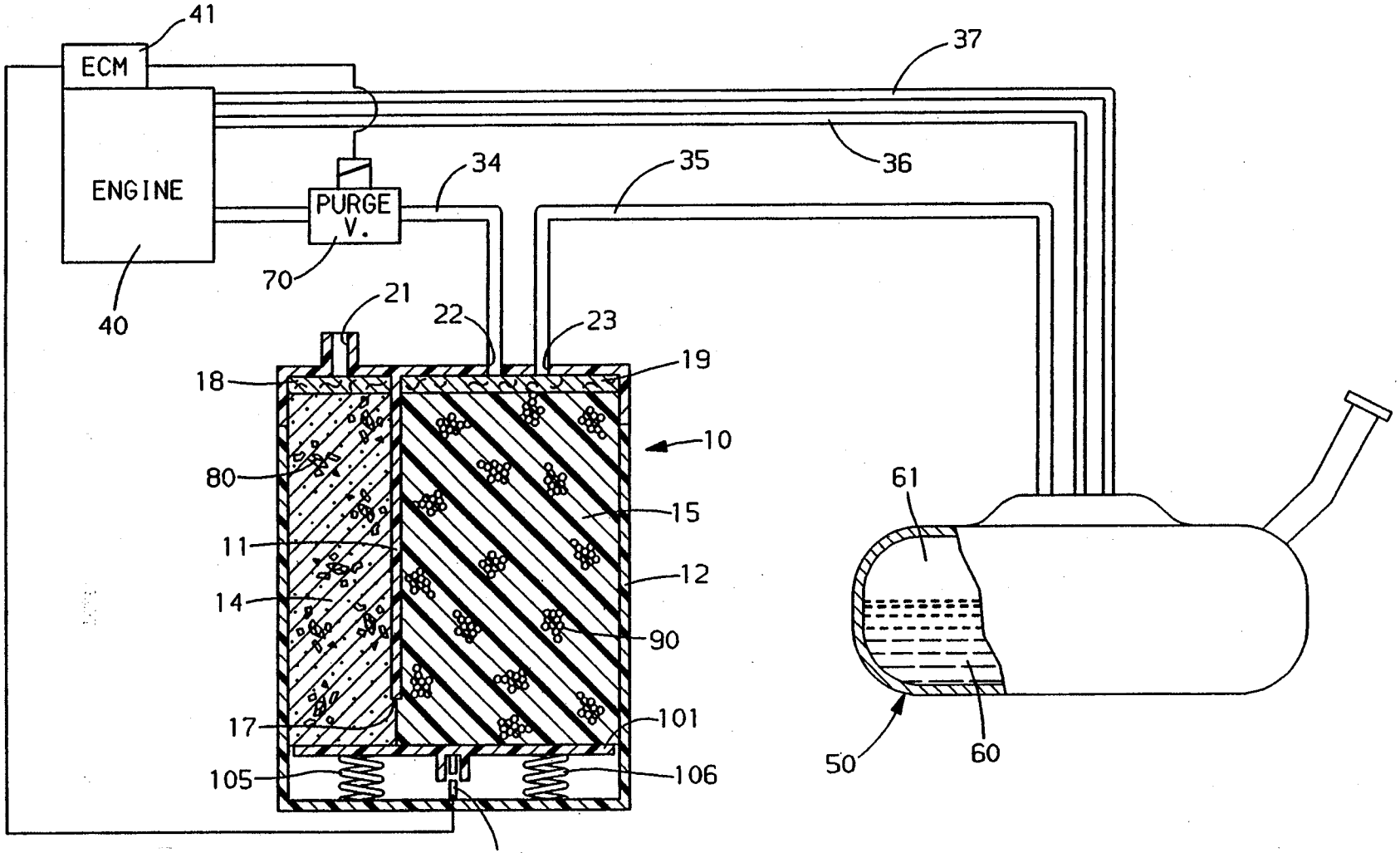
FIG. 1 is a schematic an EVAP system according to this invention.

FIG. 1 illustrates an EVAP system of a vehicle's fuel system employing principles of the present invention. The system includes a vapor storage canister 10. Canister 10 preferably includes a chambered arrangement created by the exterior wall 12 and the interior wall 11. Chambers 14 and 15 result from this arrangement. Interior wall 11 does not completely separate chamber 14 from chamber 15, rather a passage 17 is established between the chambers.

Wall 12 establishes a substantially closed container by providing a surface on all sides of the canister 10. In the preferred arrangement, wall 12 creates a canister 10, that is substantially rectangular parallelepiped in shape, although the shape is not a critical feature. Selected openings are provided in canister 10 through wall 12. Opening 21 between chamber 14 and the atmosphere functions as a vent. Opening 22, between chamber 15 and conduit 34, functions as a threshold to conduit 34 permitting selected flow out of canister 10. Opening 23, between chamber 15 and conduit 35, functions as a threshold for chamber 15 to conduit 35 permitting flow therebetween.

Conduit 35 establishes a closed flow path between canister 10 and the top of fuel tank 50 that carries a supply of fuel 60. Conduit 34 establishes a closed flow path between canister 10 and an engine 40. Conduit 34 includes normally closed purge valve 70 that functions to selectively control the fluid flow rate through conduit 34. Vent opening 21 allows the flow of air into and out of canister 10, thereby facilitating the transfer of fluid into and out of the canister through openings 23 and 22.

Chamber 14 principally contains activated carbon particles 80. Activated carbon is a conventional adsorbent used in EVAP systems. It is preferable to include an amount of activated carbon 80 in the present arrangement to optimize the adsorptive characteristics of the mechanism, although the activated carbon 80 may be excluded from the device. Chamber 14 preferably contains a screen 18 to prevent the passage of particles from chamber 14 to opening 21 and to aid in distributing air flow passing through the vent and into chamber 14. A conventional material used for screen 18 is a polymeric foam, although alternate materials can readily be substituted. Another filter 19, is preferably, similarly positioned between chamber 15 and openings 22 and 23.

Chamber 15 contains an organic polymer compound as expandable and contractible adsorbent 90. Adsorbent 90 is a material such as highly cross linked polystyrene that functions as an adsorbent and also expands upon adsorption of fuel vapors and contracts upon desorption of the vapors. An example of a suitable material is DOW XU-43546.01 which is supplied as nominal 1.5 millimeter diameter spherical beads. This material has a pore volume of approximately 1.24 cubic centimeters per gram and a surface area of approximately 1400 square meters per gram.

Other polymeric compounds that expand upon adsorption of fuel vapors and contract upon desorption, such as polypropylene and polyisoprene, are known in the art. Another material with a known property to expand in relation to the concentration of fuel vapor is silicone rubber. Therefore, alternative materials can be configured to provide the expanding and contracting function of the invention. A device using an alternative material includes a canister primarily filled with activated carbon and includes the expandable and contractible material disposed adjacent to a sensor to detect the expansion and contraction.

A moveable partition 101 is preferably disposed at the bottom of canister 10. Although partition 101 is disposed substantially about the entire bottom of canister 10, it could function sufficiently if limited to within chamber 15 for coaction with the expandable and contractible adsorbent 90. Partition 101 is biased against the adsorbent materials by springs 105 and 106. The springs urge partition 101 against the adsorbent thereby maintaining the individual particles in close proximity to one another. Although the biasing agent shown comprises springs 105 and 106, alternative devices such as a volume of resilient material may be used. Partition 101 coordinatedly moves with the expansion and contraction of adsorbent 90 in relation to the concentration of fuel vapor in the adsorbent.

Sensor 107 is disposed between partition 101 and canister wall 12. The sensor illustrated represents a contact that is closed in response to expansion of adsorbent 90 and is opened in response to contraction of adsorbent 90. Other sensing devices are readily applicable to serving this function. Known devices such as a load cell can be used to sense force when adsorbent expansion compresses partition 101 against wall 12. A sensor such as a linear motion potentiometer can be used to sense movement of partition 101. Any of numerous similar devices can be used as sensor 107 to generate signals indicative of expansion and contraction of adsorbent 90. With some conventional sensors partition 101 would not be required and therefore the device could be positioned directly in contact with adsorbent 90.

Figure 2:
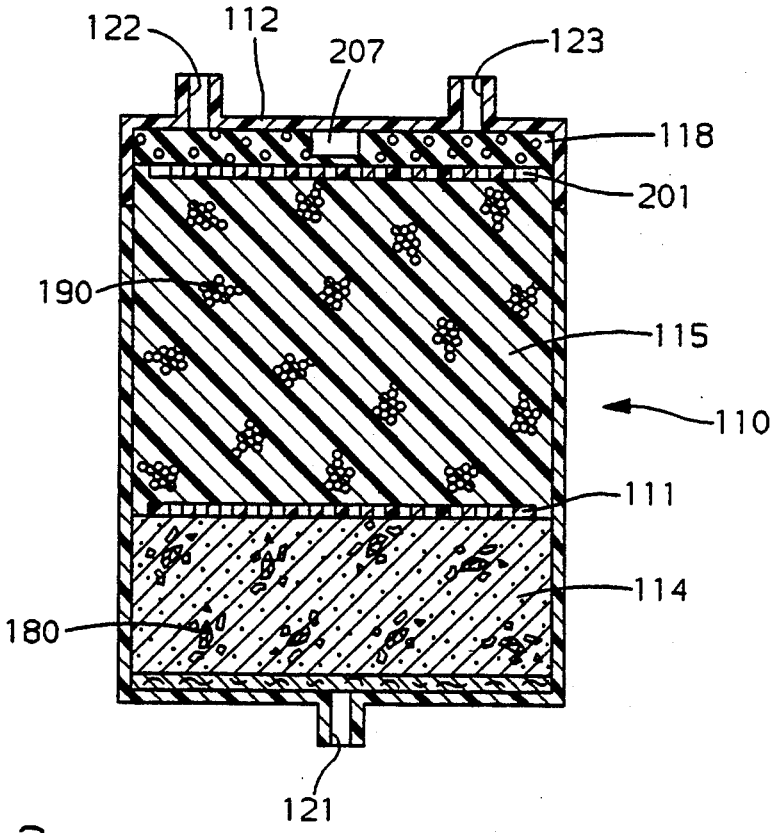
FIG. 2 is a diagram of an alternate canister arrangement.
Figure 3:
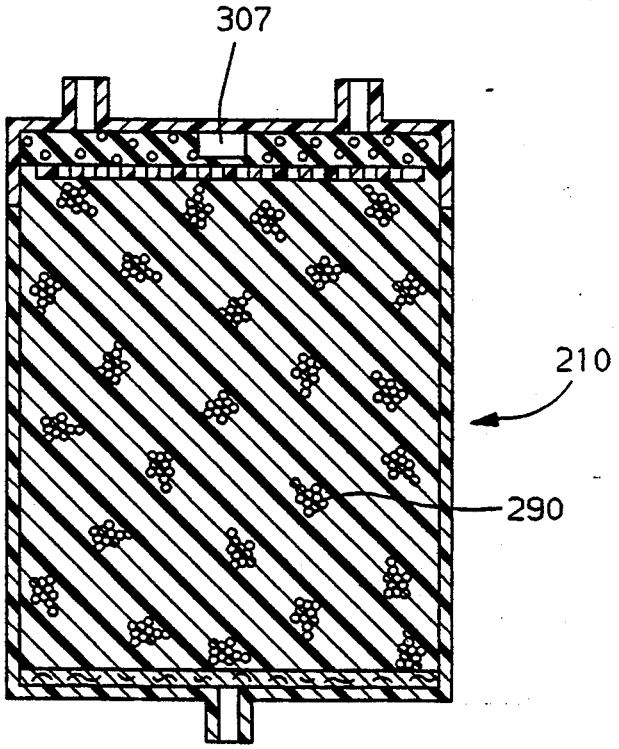
FIG. 3 is a diagram of an alternate canister arrangement.

Referring to FIGS. 2 and 3 alternative embodiments of the canister are illustrated. In FIG. 2, canister 110 is arranged with chambers 115 and 114, separated by horizontal partition 111. Horizontal partition 111 includes a plurality of openings that facilitate fluid communication between chambers 114 and 115. Chamber 115 includes expandable and contractible adsorbent 190 and chamber 114 contains activated carbon as adsorbent 180.

The canister 110 includes openings 121–123. Opening 121 serves as a vent. Openings 122 and 123 provide fluid paths for connection to conduits (not shown) permitting fluid to be transferred into and out of canister 110.

Sensor 207 is disposed between moveable wall 201 and canister wall 112. Sensor 207 is responsive to expansion and contraction of adsorbent 190 in relation to the concentration of fuel vapors in canister 110. Resilient foam 118 demonstrates compressibility upon expansion of adsorbent 190 and expandability upon contraction of adsorbent 190 biasing wall 201 against adsorbent 190.

FIG. 3 illustrates a canister substantially identical to that shown in FIG. 2 except that the activated carbon and partition are absent. In this embodiment canister 210 is substantially filled with expandable and contractible adsorbent 290. Sensor 307 provides a device to detect expansion and contraction of the adsorbent.

Figure 4:
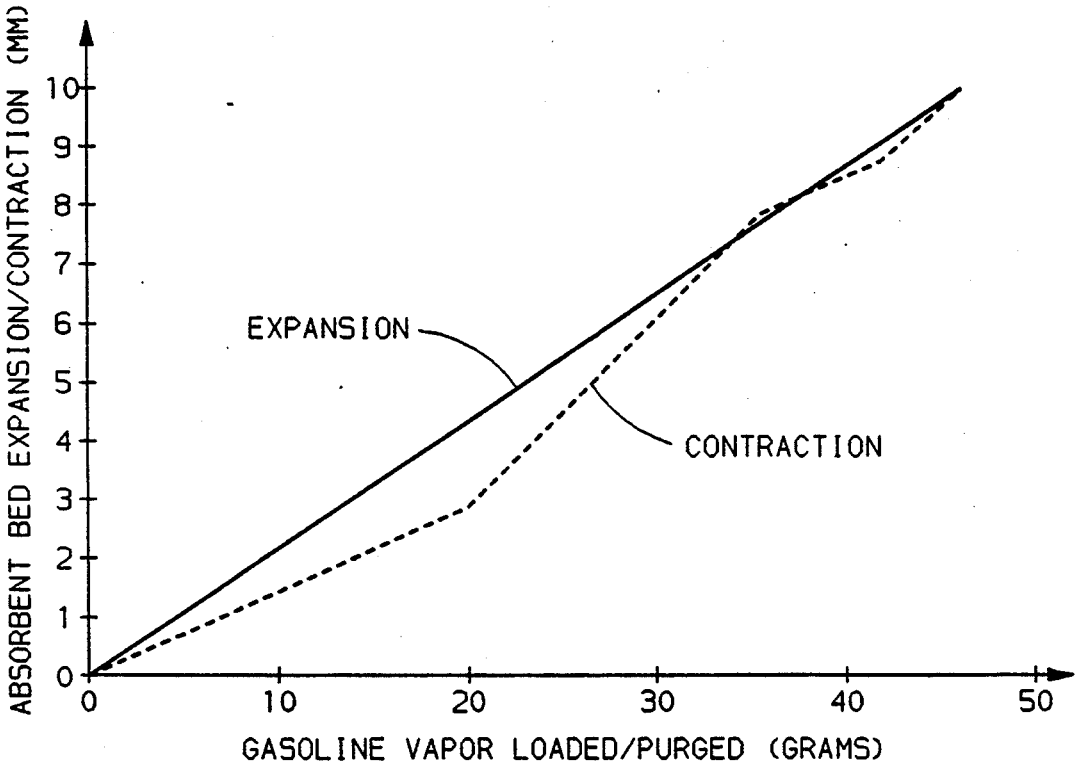
FIG. 4 is a graph of the adsorbent expansion and contraction versus gasoline vapor concentration characteristics of a swellable polymeric adsorbent.

FIG. 4 illustrates performance characteristics of a swellable polymeric adsorbent. The data represents the movement possible with this type of adsorbent arranged in a 570 cubic centimeter bed of 18 centimeters height. The solid curve represents the expansion of the adsorbent bed in response to increasing concentrations of gasoline vapor. The dashed curve represents the contraction of the adsorbent bed in response to decreasing concentrations of gasoline vapor. The resultant movement can be taken up by the springs 105 and 106 (as shown in FIG. 1) when an appropriate amount of adsorbent is contained in a closed canister arrangement.

Referring once again to FIG. 1 the adsorption process will be described. Under certain conditions vehicle fuel 60 has the capacity to give off vapor, particularly in response to changing temperatures and pressures, thereby creating a vapor constituent in the air contained in head space 61 in fuel tank 50. When the vapors cause the pressure inside tank 50 to rise above atmospheric, a flow is generated through conduit 35. Vapors entrained in the head space 61 flow through conduit 35 and enter canister 10 through opening 23. The fuel vapors are taken up by adsorbents 90 and 80 and the air is allowed to pass to the atmosphere through opening 21.

As the concentration of vapor in adsorbent 90 increases the adsorbent 90 responds with a physical increase in size, (reference is directed to FIG. 4). The increase in size creates a force against partition 101 and acts to compress springs 105 and 106. The movement of partition 101 reaches a point where the contacts of sensor 107 are closed. This indicates that the EVAP system is working correctly to collect the vapors generated in tank 50.

When the engine 40 is operated, the normally closed purge valve 70 is selectively opened to purge fuel vapors from canister 10. When purge valve 70 is open, flow is induced through conduit 34 by engine 40. Air is drawn through vent opening 21 into canister 10 desorbing vapors from adsorbent 80 and 90. The purge system operates by entraining the vapors in flow through opening 22, conduit 34 and into engine 40 for consumption.

As the concentration of vapors in adsorbent 90 decreases, there is a resulting physical decrease in the size of adsorbent 90, (reference is again directed to FIG. 4). As the size is reduced the biasing force applied by springs 105 and 106 causes partition 101 to move to maintain a particulate packed relationship in the adsorbent 90. The movement of partition 101 reaches a point where the contacts of sensor 107 are opened. This indicates that the EVAP system is working correctly to purge fuel vapors from canister 10.

The information available from sensor 107 is usable in a diagnostic program to evaluate the performance of the EVAP system. Illustrated in FIG. 1, the electronic controls or engine control module (ECM) 41 of a vehicle conventionally receives engine operational data and controls the operation of purge valve 70 accordingly. The ECM takes the form of a digital computer that can be programmed to coordinatedly run a diagnostic test to evaluate the performance of the EVAP system.

Figure 5:
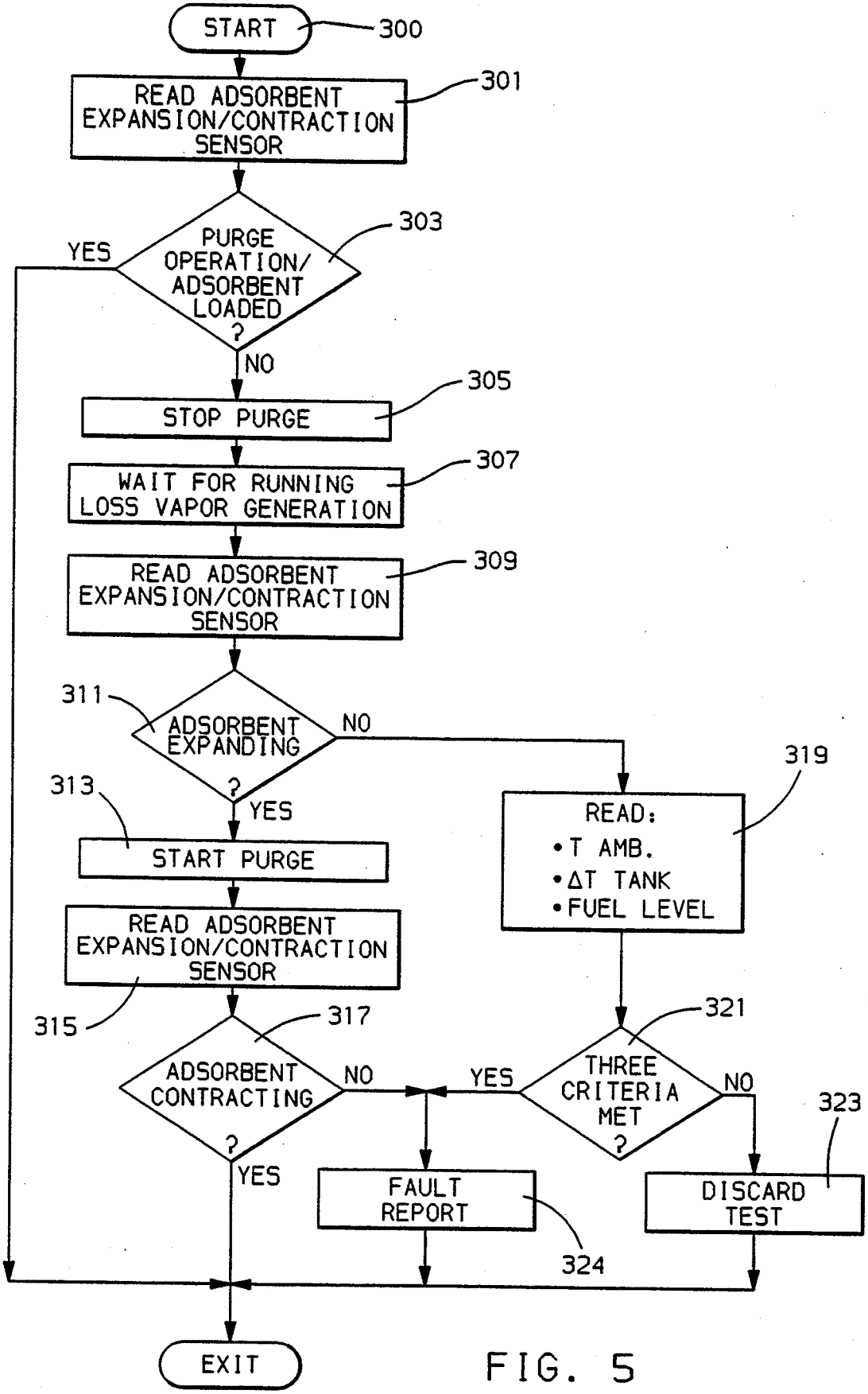
FIG. 5 is a diagram illustrating the operation of a digital control module in diagnosing a fuel vapor control system.

The diagnostic test occurs during the initial start up routine of the engine. Referring to FIG. 5, the diagnostic routine is entered at point 300 and proceeds to step 301 where a reading is taken from sensor 107. From step 301 the program proceeds to step 303 where it determines whether or not the adsorbent bed is loaded with fuel vapor and whether or not the purge system is operating.

To determine if the purge system is operating the program conducts a memory check of engine operational data, particularly fuel flow calculations which indicate whether collateral fuel vapor flow entered the engine from the EVAP system. A determination that no collateral fuel vapors have been received from the EVAP system is indeterminate and the program continues to step 305. A determination that collateral fuel vapors have been received from the EVAP system is indicative of a correctly operating purge system and a determination of adsorbent bed expansion or contraction is then made.

If the reading from sensor 107 indicates an expanded bed condition, step 303 determines that the adsorbent bed is loaded which indicates a correctly operating vapor collection system and the test is complete. If the reading from sensor 107 indicates a contracted bed condition, step 303 determines that the adsorbent bed is not loaded and the program proceeds to step 305 where a signal is generated to initiate disabling purge valve 70 from opening. When purge valve 70 is disabled, normal purging of canister 10 is prevented.

From step 305 the program proceeds to step 307 where it waits for a specified time t. During time t, the engine 40 must continue to run for the program to proceed. While the engine is running, fuel is being supplied to engine 40 from tank 50 through fuel line 36 and warmed fuel is being returned from the engine 40 to tank 50 through fuel return line 37. This fuel exchange results in an increase in temperature of fuel 60 in tank 50. In addition, fuel temperature increase occurs due to underbody air flow heated by the engine and exhaust system and other collateral sources. The increase in temperature results in running loss vapor generation by fuel 60. The generated vapor, if collected in canister 10, as is expected, causes adsorbent bed 90 to expand.

When specified time t is reached, the program continues from step 307 to step 309. In step 309 a reading is again taken from sensing means 107 and the program proceeds to step 311 where it determines whether the adsorbent bed is expanding or contracting. Since the purge valve has been closed and the engine running it can be predicted when vapor generation will occur. The generated vapor will be collected in canister 10 unless a leak in the EVAP or fuel system is allowing it to be emitted to the atmosphere or conditions are not such that vapor generation is predicted.

At step 311, a determination that the adsorbent bed is expanding, corresponds to a correctly functioning vapor collection system of the EVAP system and the program proceeds to step 313 where a signal is generated to initiate starting the purge system. At this point a conventional purge controller operates to selectively open the normally closed purge valve according to engine operational criteria in order to purge fuel vapors from the canister 10.

From step 313, after allowing time for the canister purge function of the EVAP system to take effect, the program proceeds to step 315 where a reading is again taken from sensor 107. From step 315, the program proceeds to step 317 for a determination of whether the adsorbent bed is contracting. If the purge system of the EVAP system is operating correctly the adsorbent bed should be contracting. If, in step 317 it is determined that the reading from sensor 107 indicates the adsorbent bed is contracting, the test is complete. If it is determined that the adsorbent bed is not contracting, the program proceeds to step 324 and a fault report is generated, completing the test.

From the generation of the fault report, a mechanism such as a warning light on the vehicle's instrument panel can be used to indicate to the operator that EVAP system servicing is required. Alternatively, a confirmation test can be run at a later time or the next time the vehicle is started before the operator is notified of a diagnostic test failure.

Returning to step 311, if a determination is made from the reading of sensor 107 that the adsorbent bed is not expanding, the program proceeds to step 319. At step 319, a reading is taken from three sensors (not shown), for values indicative of the ambient temperature, the temperature change that has occurred in the fuel tank as a result of engine operation and the fuel level in the fuel tank. For a determination of the fuel temperature change a comparison value corresponding to the fuel temperature when the engine was started is required and therefore, must be available in memory. The comparison value is obtained from a fuel temperature reading preferably taken when the engine is started.

Criterion values can be established for the three readings taken at step 319 that represent conditions indicative of whether or not vapor generation should be occurring at a level to load the canister. Preferred values for the conditions suitable for use as criteria are: an ambient temperature greater than approximately 50 degrees Fahrenheit, an in-tank fuel temperature increase of greater than approximately 20 degrees Fahrenheit and a fuel tank level of less than approximately 60 percent full. When these criteria are met, vapor generation sufficient to be indicated by the canister sensor 107 can be predicted.

From step 319, the program proceeds to step 321 for an evaluation of whether the three criteria are met. If all of the three criteria are not met, the program proceeds to step 323 and the test is discarded as indeterminate and complete. If all three of the criteria are met, the program proceeds to step 324 where a fault report is generated and the test is complete.

In the foregoing manner, the vapor collection system and purge system are diagnosed. The mechanism used in the preferred embodiment may readily be adapted for use in other fuel vapor handling systems that include systems to collect and purge fuel vapor.

What is claimed is:

1. An evaporative emission control system comprising:

a fuel vapor storage canister;

a swellable material within the canister expandable and contractible in response to changes in the concentration of fuel vapor in the canister; and a sensor positioned adjacent to the swellable material, wherein the expansion and contraction of the swellable material in response to changes in fuel vapor concentration as detected by the sensor is used to aid in diagnosing the system.

2. An evaporative emission control system according to claim 1 further comprising activated carbon contained within the canister.

3. An evaporative emission control system according to claim 1 further comprising a diagnostic system to determine if the evaporative emission control system is functioning correctly.

4. An evaporative emission control system that receives fuel vapor from a vehicle's fuel system and releases stored fuel vapor to the vehicle's engine induction system comprising:

a fuel vapor storage canister;

swellable adsorbent within the canister, the swellable adsorbent expandable upon adsorption of fuel vapor and contractible upon release of fuel vapor;

a vapor collection system to transfer fuel vapor to the canister;

a purge system to transfer fuel vapor from the canister to the engine induction system; and a sensor detecting expansion and contraction of the adsorbent material to aid in diagnosing whether the vapor collection system and the purge system are operating correctly.

5. An evaporative emission control system according to claim 4 wherein the canister includes a first chamber containing the swellable adsorbent and a second chamber and further comprising activated carbon contained within the second chamber.

6. An evaporative emission control system according to claim 5 wherein the canister includes a third chamber adjacent to the first chamber containing the sensor and the sensor includes:

a movable wall between the first chamber and the third chamber responsive to expansion and contraction of the swellable adsorbent biased against the swellable adsorbent; and a switch opening in response to contraction of the swellable adsorbent and closing in response to expansion of the swellable adsorbent, coupled to an electronic controller.

7. An evaporative emission control system for a vehicle having an engine and a fuel system with a fuel tank containing fuel comprising:

a fuel vapor storage canister including:

swellable adsorbent expandable upon adsorption of fuel vapor and contractible upon release of fuel vapor; and a sensor adjacent to the swellable adsorbent; and a diagnostic system to determine whether the evaporative emission control system is operating correctly by performing a multiple part diagnostic test including:

means responsive to a first signal from the sensor that the swellable adsorbent is expanded for determining whether the evaporative emission control system is functioning correctly; and means responsive to a second signal from the sensor that the swellable adsorbent is contracted for determining whether the evaporative emission control system is operating correctly.

8. An evaporative emission control system for a vehicle having an engine and a fuel system with a fuel tank containing fuel comprising:

a fuel vapor storage canister including:

swellable adsorbent expandable upon adsorption of fuel vapors and contractible upon release of fuel vapors contained in the canister; and an expansion sensor adjacent to the swellable adsorbent;

a vapor collection system to transfer fuel vapor emitted by the fuel system to the canister;

a purge system to selectively transfer fuel vapors from the canister to the engine;

a fuel tank level gauge;

a fuel temperature sensor;

an ambient air temperature sensor; and a diagnostic system to determine whether the evaporative emission control system is operating correctly by performing a multiple part diagnostic test including:

means responsive to a first signal from the expansion sensor that the swellable adsorbent is expanded for analyzing the evaporative emission control system including means for waiting a sufficient time to estimate that the canister is purged and means for determining if the sensor indicates that the swellable adsorbent is contracting; and means responsive to a second signal from the sensor that the swellable adsorbent is contracted for analyzing the evaporative emission control system including means for stopping the purge system and means for evaluating input from the fuel tank level gauge, the fuel and ambient air temperature sensors, the expansion sensor and the engine to determine whether the vapor collection system is operating correctly.

9. A method of diagnosing a fuel vapor emission control system having a canister containing a material expandable and contractible in response to changes in fuel vapor concentration and a sensor responsive to expansion and contraction of the material comprising the steps of:

reading the sensor; and determining whether the sensor reading is indicative of an expanded condition of the material corresponding to a vapor loaded condition or a contracted condition of the material corresponding to a vapor unloaded condition.

* * * * *